United States Patent [19]

Okada et al.

[11] 4,383,706

[45] May 17, 1983

[54] PRESSURE-SENSITIVE RECORDING PAPER

[75] Inventors: Yoshio Okada, Iwaki; Kimio Okubo, Hoya; Yuriko Igarashi, Iwaki, all of Japan

[73] Assignee: Kureha Kagaku Kogyo Kabushiki Kaisha, Tokyo, Japan

[21] Appl. No.: 328,737

[22] Filed: Dec. 8, 1981

Related U.S. Application Data

[63] Continuation-in-part of Ser. No. 155,787, Jun. 2, 1980.

[30] Foreign Application Priority Data

Aug. 31, 1979 [JP] Japan ..... 54/111971

[51] Int. Cl.[3] ..... B41M 5/16; B41M 5/22

[52] U.S. Cl. ..... 282/27.5; 427/150; 427/151; 428/320.6; 428/320.8; 428/537; 428/914

[58] Field of Search ..... 106/21; 282/27.5; 427/150, 151; 428/320.4, 320.6, 320.8, 537, 913, 428/914, 323, 327

[56] References Cited

U.S. PATENT DOCUMENTS

| | | | |
|---|---|---|---|
| 3,836,383 | 9/1974 | Kiritani et al. | 282/27.5 |
| 3,936,566 | 2/1976 | Sato et al. | 428/323 |
| 4,003,589 | 1/1977 | Konishi et al. | 282/27.5 |

FOREIGN PATENT DOCUMENTS

| | | | |
|---|---|---|---|
| 48-18270 | 3/1973 | Japan | 282/27.5 |
| 1352597 | 5/1974 | United Kingdom | 282/27.5 |
| 1406107 | 9/1975 | United Kingdom | 282/27.5 |
| 1526353 | 9/1978 | United Kingdom | 282/27.5 |

*Primary Examiner*—Bruce H. Hess

*Attorney, Agent, or Firm*—Wegner & Bretschneider

[57] ABSTRACT

A pressure-sensitive recording paper exhibiting excellent properties even under severe environmental conditions such as high temperature and high humidity or low temperature is offered, the pressure-sensitive recording paper comprising a paper sheet coated with microcapsules containing therein a solution of a color former in 1-isopropylphenyl-2-phenylethane as a solvent.

1 Claim, 1 Drawing Figure

PRESSURE-SENSITIVE RECORDING PAPER

CROSS-REFERENCE TO RELATED APPLICATION

This application is a continuation-in-part of U.S. patent application Ser. No. 155,787, filed June 2, 1980.

SUMMARY OF THE INVENTION

In an aspect of the invention, there is provided a pressure-sensitive recording paper comprising a paper sheet coated with microcapsules containing therein a solution of a color former in 1-isopropylphenyl-2-phenylethane as a solvent.

BACKGROUND OF THE INVENTION

The present invention relates to a pressure-sensitive recording paper, and particularly relates to a pressure-sensitive recording paper which exhibits excellent properties even under severe environmental conditions such as high ambient temperature and high humidity or low ambient temperature.

Generally, pressure-sensitive recording paper is composed of (1) a sheet of paper having its back side coated with microcapsules formed by a solution of a colorless electron-donating substance (hereinafter referred to as a color former) having a color-forming reactivity in a solvent (hereinafter referred to as a CB paper) combined with another sheet of paper having its front side coated with a color-developing substance (hereinafter referred to as a developer) which can form a coloring product in reacting with the color former (hereinafter referred to as a CF paper; (2) a sheet of paper having its both sides coated with the microcapsules and the developer, respectively (hereinafter referred to as a CFB paper) combined with the CB paper and the CF paper; or (3) a sheet of paper having its one side coated together with the microcapsules and the developer. In either case of these pressure-sensitive recording papers, an artificial application of a pressure on the paper breaks the microcapsules at the pressured part to bring the color former into contact with the developer resulting in color development.

In the pressure-sensitive recording paper constituted as mentioned above, the matters which give an important influence on the quality of the pressure-sensitive recording paper are the solvent of the color former included in the microcapsules and the wall material which forms the microcapsule. Hitherto, the specific properties required for the solvent have been as follows:

(1) it dissolves the color former to a high concentration, (2) when applied in the pressure-sensitive recording paper, the velocity of color-development, the color-density and the color stability after color-development are high, (3) it is stable against light, heat and chemicals, (4) it is substantially odorless, (5) it is harmless to human body, (6) it has a sufficient biodegradability and accordingly, it does not cause environmental pollution.

On the other hand, uniformity and excellent mechanical strength are required for the wall material of the microcapsules, and the microcapsules are normally prepared by the so-called complex coacervation method.

As the wall material which fulfills the requisites and is easily subjected to microencapsulation, several high molecular substances have been offered, however, at present, gelatin is widely used as the most suitable wall material.

However, in recent years, the utilization of pressure-sensitive recording papers has come to propagate throughout the world and they have come to be used even under a hot and humid climate or very cold climate.

Accordingly, during the period of transportation for the exporting the pressure-sensitive recording papers or the period of warehouse-storage of the papers in the regions of extreme climates, the chance of exposure of the pressure-sensitive recording papers to severe environmental conditions or the chance of usage under such severe environmental conditions has been increased.

The term "severe environmental conditions" herein used means the so-called hot and humid environmental conditions of an ambient temperature of about 40° to 50° C. and of a relative humidity of higher than about 80%, and the cold environmental condition of an ambient temperature of lower than about 0° C.

In the case where the pressure-sensitive recording paper is left for a long time under the hot and humid environmental conditions, the solution of the color former included in the microcapsules of the pressure-sensitive recording paper exudes to outside of the capsule with a result of causing undesirable color-development before the use of the paper and of damaging the paper by contamination to prevent the satisfactory color-development in its proper use time. Such a damage might cause a fatal problem that the so-damaged pressure-sensitive recording paper is no more to be offered to actual use.

On the other hand, in the case where the pressure-sensitive recording paper is used in the very cold region, it takes a long period of time to develop a sufficiently visible color and accordingly, the recording can not be read for a considerable time period and so there is a problem that the paper is no more to be offered in actual use.

However, hitherto, since the pressure-sensitive recording paper has not been propagated to the degree that it is often exposed to the severe environmental conditions or used in the severe environment, it has not been recognized at all that the pressure-sensitive recording paper should have maintained its excellent properties at its specific important requisite even under the severe environmental conditions. Accordingly, there has never been any literature on the pressure-sensitive recording paper which is able to keep the excellent properties even under the severe environmental conditions.

It will be very important to select the solvent of color former in the microcapsules in order to offer a pressure-sensitive recording paper having the excellent properties even in the severe environmental conditions, and a selection of the solvent has been carried out. However, the selection of the solvent which is able to fulfill the requisites (1) to (6) even in the severe environmental conditions is extremely difficult. The difficulty would be due to the contradiction of the properties which should be fulfilled by the solvent in the climatically hot and humid region and the properties which should be fulfilled by the same solvent in the very cold region. However, quite surprisingly it was found that 1-isopropylphenyl-2-phenylethane had a specific property to fulfill the requisites under the severe environmental conditions, that is, both under the climatically hot and humid environmental conditions and under the very cold environmental conditions of lower than 0° C.

It is an object of the present invention to provide a compound as the solvent dissolving a color former for pressure-sensitive recording paper, which the compound is able to fulfill the specific properties requires:

(1) To have high solubility to dissolve the color former, (2) To have a high velocity of color-development, a high color-density and a high color stability after color-development, when applied in the pressure-sensitive recording paper, (3) To be stable against light, heat and chemicals, (4) To be substantially odorless, In which the properties (1) to (4) are fulfilled even under the hot and humid environmental conditions, and under the very cold environmental conditions, (5) To be harmless to the human body, and (6) To have a sufficient biodegradability, and thereby to offer a pressure-sensitive recording paper which is stable and is possibly put to practical use even under the severe environmental conditions.

The other object of the present invention will be elucidated from the following descriptions:

DETAILED DESCRIPTION OF THE INVENTION

Figure 1:
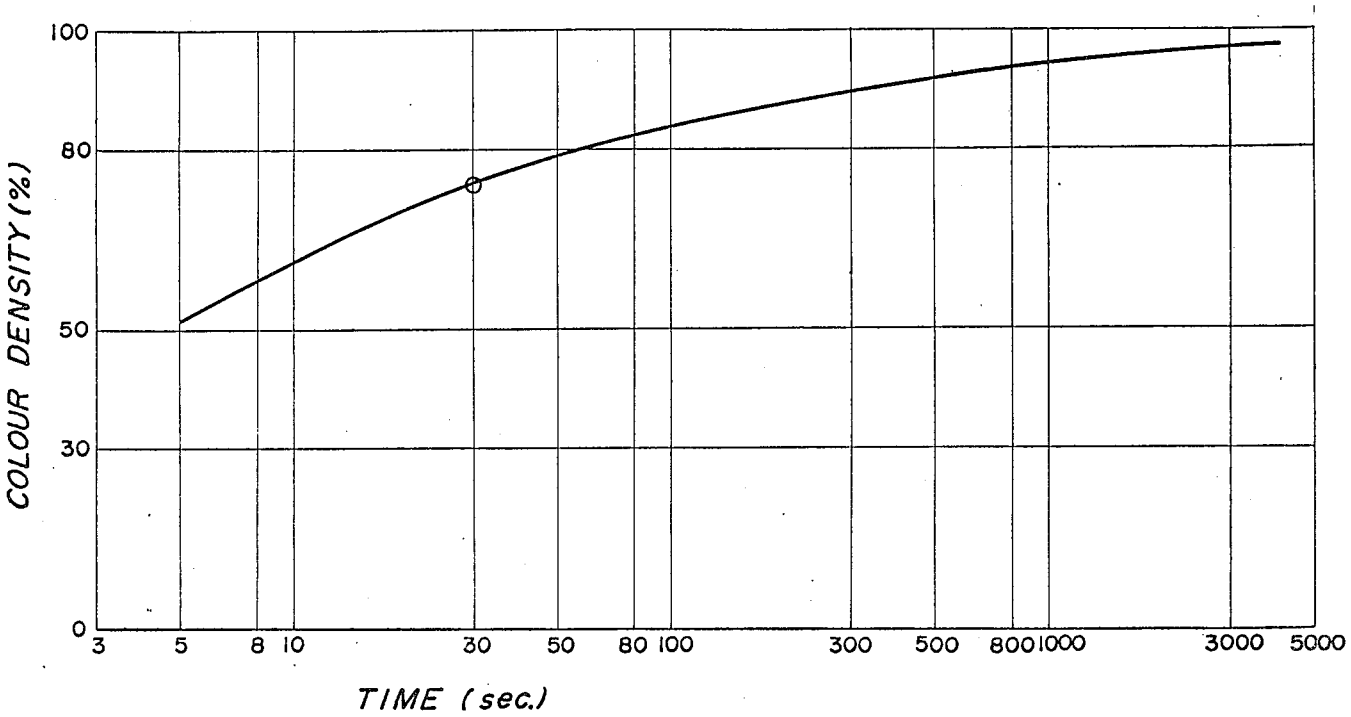
FIG. 1 of the drawing illustrates the change of color density of a pressure-sensitive recording paper prepared by the procedure described in Example 1 shown later on, at a low temperature of −5° C. in a graph.

The characteristic feature of the present invention is that, in the preparation of a pressure-sensitive recording paper, microcapsules containing therein a solution of the color former in 1-isopropylphenyl-2-phenylethane are coated on a sheet of paper constituting the pressure-sensitive recording paper.

The structural formula and physical properties of 1-isopropylphenyl-2-phenylethane for use as the solvent of the color former in the present invention are shown below.

Structural formula:

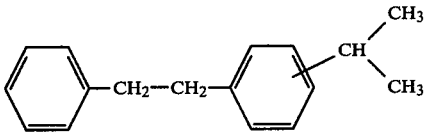

Boiling point: 313° to 315° C./760 mmHg

Specific gravity: 0.963 ($d_4^{15}$)

Kinematic viscosity: 4.5 cst at 100° F.

In addition, the compound is synthesized, for instance, as follows:

(a) Benzene and 1,2-dichloroethane are brought into condensation in the presence of aluminum chloride as a catalyst to obtain 1,2-diphenylethane, and the thus formed 1,2-diphenylethane is subjected to propylation to form 1-isopropylphenyl-2-phenylethane, or (b) Benzene and cumen are brought into reaction with 1,2-dichloroethane in the presence of aluminum chloride as a catalyst to obtain 1-isopropylphenyl-2-phenylethane. The resultant 1-isopropylphenyl-2-phenylethane is a substantially odorless and colorless liquid which is a mixture of predominantly 1-(3′-isopropylphenyl)-2-phenylethane and 1-(4′-isopropylphenyl)-2-phenylethane, with a minor amount of 1-(2′-isopropylphenyl)-2-phenylethane. Although the mixture of the isomers of 1-isopropylphenyl-2-phenylethane is used in the tests conducted on the present invention, it should be noted that if 1-(3′-isopropylphenyl)-2-phenylethane is to be used by itself then this is included within the scope of the present invention, each of the three position isomers being recoverable from the mixture of isomers produced in accordance with the above procedure. Similarly, 1-(4′-isopropylphenyl)-2-phenylethane may be used as the isomer and similarly recovered. Although present in a minor amount according to the procedure described above, 1-(2′-isopropylphenyl)-2-phenylethane may also be recovered and used by itself if so desired.

Although 1-isopropylphenyl-2-phenylethane for use in the present invention, as is shown in Examples later on, is able to fulfill the requisites (1) to (6) required for the solvent of the pressure-sensitive recording paper sufficiently even under the hot and humid environmental conditions and also under the very cold environmental conditions, it is considered to be remarkable from the scientific common knowledge that the compound has such a specific property.

According to the conventional scientific knowledge, the characteristic feature of chemical structure of a solvent which acts stably in the pressure-sensitive recording paper under the hot and humid environmental conditions is said to be high in aliphaticity with a high molecular weight, and on the other hand, the characteristic feature of chemical structure of a solvent which gives a pressure-sensitive recording paper showing a favourable colour-developing property under the very cold environmental conditions is said to be high in aromaticity with a low molecular weight. That is, the characteristic feature of chemical structure of a solvent which gives a pressure-sensitive recording paper stable under the hot and humid environmental conditions and that of a solvent which gives a pressure-sensitive recording paper showing a favourable color-developing property under the climatically very cold environmental conditions contradict each other. Accordingly, it should be considered that it is actually almost impossible to presume and adopt a chemical compound for a pressure-sensitive recording paper which maintains its excellent quality under both conditions, from the chemical structure.

Although, in the present invention, it is most preferable to use 1-isopropylphenyl-2-phenylethane alone, as a solvent, it may be used after mixing with another solvent unless its specific properties are not disturbed.

In addition, since 1-isopropylphenyl-2-phenylethane is excellent in dissolving various color formers for use in the pressure sensitive recording paper, the color former for use in the present invention possibly includes, for instance, benzoyl leucomethylene blue (BLMB), crystal violet lactone (CVL), malachite green lactone and diaminofluorane derivatives such as 3-dialkylamino-7-dialkylaminofluorane, etc.

Moreover, in the present invention, as a developer, those hitherto been used, for instance, acid clay, phenol resin, derivatives of salicylic salts, etc. are possibly used.

Examples shown below are the concrete exemplification of the preparation of the pressure-sensitive recording paper according to the present invention and the improved effectiveness of the pressure-sensitive recording paper. Accordingly, it will be understood that the scope of the present invention is not restricted within Examples.

EXAMPLE 1

Synthesis of 1-isopropylphenyl-2-phenylethane

Synthesis (A)

In a stainless-steel autoclave of a capacity of one liter, 1 mol of 1,2-diphenylethane and 2 mols of benzene were charged to form a solution, and after introducing a silica-alumina catalyst in an amount corresponding to 30% by weight of the solution into the autoclave and replacing the aerial space of the autoclave with gaseous nitrogen, 3 mols of propylene was introduced into the autoclave.

The content of the autoclave was brought into reaction by heating it to 270° C. while stirring. After continuation of the reaction for 2 hours at the temperature, the autoclave was cooled to the ordinary temperature and the content was collected and separated from the catalyst by filtration. By rectifying the filtrate, about 80 g of the product, 1-isopropylphenyl-2-phenylethane was obtained. The physical properties of the product were:

Boiling point: 313° to 315° C./760 mmHg,

Specific gravity: 0.963 ($d_4^{15}$), and

Kinematic viscosity: 4.5 cst at 100° F.

The isomeric composition of the product was:

54% by weight of 1-(3'-isopropylphenyl)-2-phenylethane,

41% by weight of 1-(4'-isopropylphenyl)-2-phenylethane and

5% by weight of 1-(2'-isopropylphenyl)-2-phenylethane.

Synthesis (B)

In a separable flask, 5 mols of benzene, 5 mols of cumen and 0.5 mol of aluminum chloride as a catalyst were introduced, and after heating the flask to a temperature of 70° C. in a warm water bath, 2 mols of 1,2-dichloroethane were added to the mixture drop-wise under agitation while removing the evolving gaseous hydrogen chloride and the reaction was continued for 3 hours. After the reaction was over, and after separating the reaction product from the catalyst, the product was washed with water and subjected to vacuum distillation to obtain colorless 1-isopropylphenyl-2-phenylethane. The thus obtained 1-isopropylphenyl-2-phenylethane was a mixture of 59% by weight of 1-(3'-isopropylphenyl)-2-phenylethane, 38% by weight of 1-(4'-isopropylphenyl)-2-phenylethane and 3% by weight of 1-(2'-isopropylphenyl)-2-phenylethane.

The properties of the thus obtained product were:

Boiling point: 313° to 315° C./760 mmHg,

Specific gravity: 0.963 ($d_4^{15}$), and

Kinematic viscosity: 4.5 cst/100° F.

Preparation of microcapsules

Into 150 g of 1-isopropylphenyl-2-phenylethane obtained by Synthesis (B), 2.7 g of crystal violet lactone and 1.8 g of leucomethylene blue were dissolved, and the solution was added to an aqueous solution of 30 g of gelatin in 270 g of water to be emulsified, and then an aqueous 30 g of gum arabic solution in 270 g of water was added to the emulsified solution while maintaining the temperature of the mixture at 50° C. under agitation. In the next place, using an aqueous 50% acetic acid solution, the pH of the mixture was slowly reduced to 4.4 to cause a coacervation and by cooling the temperature of the mixture to 10° C. the membrane of the thus formed microcapsules was solidified, and 20 ml of an aqueous 25% solution of glutaraldehyde were added to the liquid including the microcapsules. The membrane of the microcapsules was further solidified by making the pH of the mixture to be 9 with the addition of an aqueous 10% solution of sodium hydroxide to make the capsulation completed.

Preparation of a pressure-sensitive recording paper

The thus obtained microcapsules were coated on one side of a weighed sheet of paper of 45 g/m$^2$ at a rate of dried material of 5 g/m$^2$ to obtain a CB paper, and it was combined with a CF paper prepared by the conventional method to prepare a pressure-sensitive recording paper.

EXAMPLE 2

Test 1

The test 1 shows the results of examination carried out on the pressure-sensitive recording paper according to the present invention under the hot and humid conditions. After leaving a pressure-sensitive recording paper prepared by the procedures described in Example 1 in a cabinet maintained at a constant temperature of 40° C. and at a constant relative humidity of 90% for 16 hours, the paper was made to develop a color by subjecting the paper to callender-rools and the color density was determined by a refraction color densitometer (manufactured by MacBeth Company).

In parallel, another pressure-sensitive recording paper prepared by the same procedures as described in Example 1 and left in an atmosphere of temperature of 15° C. and a relative humidity of 65% for 16 hours was made to develop a color by the same procedures as above, and its color density was determined as above. Then, the percentage of the color density of the pressure-sensitive recording paper left in the hot and humid conditions described above to the color density of the latter pressure-sensitive recording paper left in the atmosphere of temperature of 15° C. and a relative humidity of 65% for 16 hours (as the standard) was obtained by calculation. It was 70%. From this percentage, it is recognizable that the pressure-sensitive recording paper prepared in Example 1 did not show considerable reduction of quality even under the severe environmental conditions, and accordingly is stable enough.

Test 2

The Test 2 shows the velocity of color development of the pressure-sensitive recording paper according to the present invention under very cold climatic environmental conditions.

A sheet of the pressure-sensitive recording paper prepared by the procedures described in Example 1 was subjected to the procedure of calender-rolling to develop a color at an ordinary temperature, and the color density of the thus treated pressure-sensitive recording paper was determined by a refractive color densitometer (manufactured by MACBETH Company) and the determined value, A, was used as a standard.

Meanwhile, another sheet of the same paper as above was subjected to the same procedure as above, however, in a room maintained at a temperature of −5° C. Its color density was determined as above to be B.

The percentage of B to A, i.e., $(B/A)\times 100$, was utilized to express the velocity of color development of the paper at a temperature of −5° C. The results are shown in the annexed drawing.

As is seen in the drawing, the velocity of color development of the pressure-sensitive recording paper prepared by the procedures in Example 1 at a temperature, for instance, of −5° C. after 30 sec was 70%, showing the small effect under the low temperature of −5° C. The results are shown in the attached figure. As is seen in the results, the pressure-sensitive recording paper of the present invention gives a clear color development and is stable even at a low temperature.

Test 3

The test 3 shows the results of examination on the biodegradability of 1-isopropylphenyl-2-phenylethane for use in the present invention.

In a 300 ml-conical flask, 1-isopropylphenyl-2-phenylethane prepared by the procedures described in Example 1 and an activated sludge were introduced together with a culture medium so as to make the concentrations of the two substances at 200 and 100 ppm, respectively to the medium, and the sludge was cultured for 2 weeks under shaking. After the cultivation, the extract of the cultured broth with a solvent was subjected to gaschromatography to determine the rate of biodegradation of 1-isopropylphenyl-2-phenylethane. The result showed that 1-isopropylphenyl-2-phenylethane remained as small as 15% of the originally introduced amount, that is, the biodegradability of the compound was high as 85%.

Test 4

The test 4 shows the results of examination on the stability of the pressure-sensitive recording paper according to the present invention under climatically hot and low-humid environmental conditions.

A pressure-sensitive recording paper prepared according to the procedures described in Example 1 was left for 16 hours in a dryer kept at a constant temperature of 105° C. The thus treated pressure-sensitive recording paper was successively subjected to color development according to the procedures described in the Test 1, and its color density was compared with the standard color density of another pressure-sensitive recording paper prepared by the same procedures as above, then kept for the same period in a normal environment at a room temperature and subject to color development. The color density of the former was 97% of the latter. The result shows that the pressure-sensitive recording paper according to the present invention is stable even under the severe environmental conditions of hot and low-humid.

Test 5

The Test 5 shows the result of an examination of the odor of 1-isopropylphenyl-2-phenylethane.

The odor of 1-isopropylphenyl-2-phenylethane was rated by inventors according to the following codes.

Rating:

A: substantially no odor

B: slight odor

C: intermediate odor (disqualified)

D: strong odor (disqualified)

The result of the examination was "A".

COMPARATIVE EXAMPLE

Pressure-sensitive recording papers were prepared according to the same procedures as described in Example 1, except for using each of the solvents shown in the following Table instead of 1-isopropylphenyl-2-phenylethane.

Test 1

The stability of each one of the thus prepared pressure-sensitive recording papers under the climatically hot and humid conditions was examined by the same procedure as described in the Test 1 of Example 2. The results are shown in the Table below.

Test 2

The color developing property of each one of the thus prepared pressure-sensitive recording papers under the very cold environmental conditions was examined by the procedures described in the Test 2 of Example 2. The results are shown in the Table below.

Test 3

The biodegradability of each one of the thus prepared pressure-sensitive recording papers were examined by the procedures described in the Test 3 of Example 2. The results are shown in the Table below.

Test 4

The stability of each one of the thus prepared pressure-sensitive recording papers under climatically hot and low-humid environmental conditions was examined by the procedures described in the Test 4 of Example 2. The results are shown in the Table below.

Test 5

The odor of each one of the solvents was examined by the procedures described in the Test 5 of Example 2. The results are shown in the Table below.

TABLE

| Solvent | | Stability at hot and humid condition (%) | Color-development at low temperature (%) | Stability at hot condition (%) | Biodegradability (%) | Odor |
|---|---|---|---|---|---|---|
| 1-isopropylphenyl-2-phenylethane | The present invention | 71 | 74 | 97 | 85 | A |
| 2,4-dimethyl-diphenylmethane | The publicly known solvents (U.S. Pat. No. 3,836,383) | 15 | 76 | 98 | 35 | D |
| ethyl-diphenyl-methane | | 11 | 89 | 97 | 52 | D |
| 1-1-di-p-toluyl-ethane | | 18 | 65 | 98 | 10 | B |
| 1,2-bis-tolylethane | | 11 | 76 | 98 | 28 | B |
| 1-(2,4-dimethyl-phenyl)-1-phenyl-ethane | The publicly known solvents (U.S. Pat. No. 3,936,566) | 16 | 54 | 98 | 19 | C |
| 1-ethylphenyl-1- | | 16 | 83 | 96 | 23 | C |

TABLE-continued

| Solvent | Stability at hot and humid condition (%) | Color-development at low temperature (%) | Stability at hot condition (%) | Biodegradability (%) | Odor |
|---|---|---|---|---|---|
| phenylethane 1-isopropylphenyl-1-phenylethane | 48 | 63 | 50 | 16 | B |

What is claimed is:

1. A pressure-sensitive recording paper comprising a paper sheet coated with microcapsules containing therein a solution of a color former in 1-isopropylphenyl-2-phenylethane as a solvent.

* * * * *